US009704495B2

(12) United States Patent
Jain et al.

(10) Patent No.: US 9,704,495 B2
(45) Date of Patent: Jul. 11, 2017

(54) MODIFIED MEL FILTER BANK STRUCTURE USING SPECTRAL CHARACTERISTICS FOR SOUND ANALYSIS

(71) Applicant: Tata Consultancy Services Limited, Mumbai (JP)

(72) Inventors: Jitendra Jain, West Bengal (IN); Aniruddha Sinha, West Bengal (IN)

(73) Assignee: Tata Consultancy Services Limited (IN)

( * ) Notice: Subject to any disclaimer, the term of this patent is extended or adjusted under 35 U.S.C. 154(b) by 58 days.

(21) Appl. No.: 14/380,297

(22) PCT Filed: Feb. 11, 2013

(86) PCT No.: PCT/IN2013/000089
§ 371 (c)(1),
(2) Date: Aug. 21, 2014

(87) PCT Pub. No.: WO2013/124862
PCT Pub. Date: Aug. 29, 2013

(65) Prior Publication Data

US 2015/0016617 A1 Jan. 15, 2015

(30) Foreign Application Priority Data

Feb. 21, 2012 (IN) ..... 462/MUM/2012

(51) Int. Cl.
*H04R 29/00* (2006.01)
*G10L 19/02* (2013.01)
(Continued)

(52) U.S. Cl.
CPC ..... *G10L 19/02* (2013.01); *G10L 25/51* (2013.01); *G10L 25/18* (2013.01)

(58) Field of Classification Search
CPC ... G10L 21/0208; G10L 15/02; G10L 19/012; G10L 21/02; G10L 21/0272; G10L 15/20;
(Continued)

(56) References Cited

U.S. PATENT DOCUMENTS 5,771,299 A 6/1998 Melanson
5,864,806 A 1/1999 Mokbel
(Continued)

FOREIGN PATENT DOCUMENTS

CN 101226743 12/2007
EP 0907258 10/1998
(Continued)

OTHER PUBLICATIONS

Tom L. H. Li and Antoni B. Chan, "Gene Classification and the Invariance of MFCC Features to Key and Tempo", International Conference on MultiMedia Modeling, Taipei, 2011.
(Continued)

*Primary Examiner* — Lun-See Lao
(74) *Attorney, Agent, or Firm* — Finnegan, Henderson, Farabow, Garrett & Dunner, L.L.P.

(57) ABSTRACT

A system and method for detection of sound of interest amongst plurality of other dynamically varying sounds is disclosed. In one embodiment, a spectrum detector identifies dominant spectrum energy frequency by detecting the dominant spectrum energy band present in spectrum of sound energy. A modified mel filter bank is designed by revising spectral positioning of the first mel filter bank and the second mel filter bank according to the identified dominant frequency. A feature extractor extracts the features from first mel filter bank, second mel filter bank and the modified mel filter bank which are further classified in order to detect the sound of interest.

11 Claims, 9 Drawing Sheets

(51) Int. Cl.
*G10L 25/51* (2013.01)
*G10L 25/18* (2013.01)

(58) Field of Classification Search
CPC ..... G10L 25/78; G10L 21/0232; G10L 25/05; G10L 25/90; G10L 17/26; G10L 2025/783; G10L 2021/02165; H04R 29/00; H04R 2225/41; H04R 2430/03; H04R 2499/11; H04R 3/04; H04R 1/028; H04R 1/1083; H04R 2410/05; H04R 2410/07; H04R 2499/13; H04R 25/505; H04R 25/507; H04R 3/00; H04R 3/005
USPC ..... 381/56–58, 122, 103, 94.2, 61; 700/94; 704/230, 231, 255, 251, 233
See application file for complete search history.

(56) References Cited

U.S. PATENT DOCUMENTS 6,253,175 B1 * 6/2001 Basu ..... G10L 15/02 704/231
8,194,865 B2 6/2012 Goldstein
8,301,284 B2 * 10/2012 Aoki ..... G06F 17/30743 700/94
8,412,525 B2 4/2013 Mukerjee et al.
2003/0055639 A1 * 3/2003 Rees ..... G10L 25/78 704/233
2008/0267416 A1 * 10/2008 Goldstein ..... H04R 1/1091 381/56
2010/0185713 A1 * 7/2010 Aoki ..... G06F 17/30743 84/609

FOREIGN PATENT DOCUMENTS

EP 2028647 8/2007
WO 9922364 10/1998

OTHER PUBLICATIONS

S. Wegener, M. Haller, J.J. Burred, T. Sikora, S Essid, G. Richard, "On The Robustness of Audio Features for Musical Instrument Classification", European Commission under the IST FP6 research network of excellence K-Space.
Li Tan and Montri Karnjanadecha, "Modified Mel-Frequency Cepstrum Coefficient", Department of Computer Engineering, Faculty of Engineering, Thailand.
International Search Report of PCT/IN2013/000089, dated Jul. 26, 2013 (2 pages).

* cited by examiner

MODIFIED MEL FILTER BANK STRUCTURE USING SPECTRAL CHARACTERISTICS FOR SOUND ANALYSIS

CROSS-REFERENCE TO RELATED PATENT APPLICATIONS

This application is a National Stage Entry under 35 U.S.C. §371 of International Application No. PCT/IN2013/000089, filed Feb. 11, 2013, which claims priority from Indian Patent Application No. 462/MUM/2012, filed Feb. 21, 2012. The entire contents of the above-referenced applications are expressly incorporated herein by reference for all purposes.

FIELD OF THE INVENTION

The present invention relates to a system and method for detecting a particular type of sound amongst a plurality of sounds. More particularly, the present invention relates to a system and method for detecting sound while considering spectral characteristics therein.

PRIOR ART REFERENCES

[1]. Rijurekha Sen, Vishal Sevani, Prashima Sharma, Zahir Koradia, and Bhaskaran Raman, "Challenges In Communication Assisted Road Transportation Systems for Developing Regions", In NSDR '09, October 2009.

[2]. Prashanth Mohan, Venkata N. Padmanabhan, Ramachandran Ramjee, "Nericell: Rich Monitoring of Road and Traffic Conditions using Mobile Smartphones", Sensys '08—From Microsoft Research Labs.

[3]. Vivek Tyagi, Shivkumar Kalyanaraman, Raghuram Krishnapuram, "Vehicular Traffic Density State Estimation Based on Cumulative Road Acoustics", IBM Research Report.

[4]. Sandipan Chakroborty, Anindya Roy, and Goutam Saha, "Improved Closed Set Text-Independent Speaker Identification by combining MFCC with Evidence from Flipped Filter Banks", International Journal of Information and Communication Engineering, 2008.

[5]. Arun Ross, Anil Jain, "Information fusion in biometrics", Pattern Recognition Letters, 2003.

[6]. "A Method and System for Association and Decision Fusion of Multimodal Input", Indian Patent Application Number 145 l/MUM/2011.

[7]. Douglas A. Reynolds, Richard C. Rose, "Robust Text-Independent Speaker Identification Using Gaussian Mixture Speaker Models", IEEE Trans. on Speech and Audio Processing, vol. 3, no. 1, 1995.

BACKGROUND OF THE INVENTION

Observation of spectral characteristics is performed for characterizing different type of sounds. The soundscaping has an application in the areas of music, health care, noise pollution etc. In order to differentiate a particular type of sound with the other sounds, mel frequency filter banks are highly used. Mel Frequency Cepstral Coefficients (MFCC) [reference 4] is commonly used as features in speech recognition systems. They are also used for audio similarity measures. For example, in road traffic conditions [references 1, 2, 3] MFCC are used to differentiate the horn sound with the other traffic sounds. This is done to reduce the probability of road accidents by correctly identifying the horn sound.

Many of the solutions have been proposed to detect and track a particular type of sound by using mel filter banks.

MFCC (Mel Frequency Cepstral Coefficients) are largely used for classification of sounds. In the existing systems designed for sound detection, feature selection is mainly based on mel frequency cepstral coefficients. Further, good results are observed by employing the GMM (Gaussian Mixture Model) [reference 7], or any other model, for classification purpose. The existing mel filter bank structures are more suitable for speech as they effectively captures the formant information of speech due to the high resolution in lower frequencies. However, all such systems remain silent on the usage of spectral characteristics of sound in the design of the filter bank and do not consider it while selecting features which may provide the better results. Modifying the mel filter bank by observing the spectral characteristic may provide better classification of a particular type of sound. Also, threshold based methods are used for a particular sound detection by observing the spectrum but these methods cannot work for all the cases where there is variation in frequency spectrum.

Large number of prior art also teaches about the sound recognition system and processes. EP0907258 discloses about audio signal compression, speech signal compression and speech recognition. CN101226743 discloses about the method for recognizing speaker based on conversion of neutral and affection sound. EP2028647 provides a method and device for speaker classification. WO1999022364 teaches about system and method for automatically classifying the affective content of speech. CN1897109 discloses about the single audio frequency signal discrimination based MFCC. WO02010066008 discloses about multi-parametric analyses of snore sounds for the community screening of sleep apnea with non-gaussianity index. However, all these prior arts remain silent on considering the varying frequency distribution in sound energy spectrum in order to provide an improved classification.

Therefore, there is a need of a system and method which is capable of detecting a particular type of sound by considering the spectral characteristics of sound for designing the filter bank structure. Also, the system and method should be capable of detecting sound while reducing the complexity.

OBJECTS OF THE INVENTION

It is the primary object of the invention to design a modified mel filter bank to effectively detect the sound of interest amongst dynamically varying sounds.

It is another object of the invention to provide a method for identifying a dominant frequency in the energy spectrum of dynamically varying sounds.

It is yet another object of the invention to provide a system for fusing the different features (MFCC) extracted from one or more different mel filter bank.

It is yet another object of the invention to provide a system for classifying the extracted spectral characteristics to effectively detect the sound of interest.

SUMMARY OF THE INVENTION

The present invention provides a system for detection of sound of interest amongst a plurality of other dynamically varying sounds. The system comprises of a spectrum detector to identify a dominant spectrum energy frequency by detecting the dominant spectrum energy band present in a spectrum of sound energy of the varying sounds and a modified mel filter bank comprising a first mel filter bank and a second mel filter bank. Each mel filter in the bank is configured to filter frequency band of sound energy for detecting the sound of interest. The modified mel filter bank configured with a revised spectral positioning of the first mel filter bank and the second mel filter bank according to the identified dominant frequency for detection of the sound of interest. The system further comprises of a feature extractor, coupled with the modified mel filter bank, configured to extract a plurality of spectral characteristic of the sound received from the modified filter bank and a classifier trained to classify the extracted spectral characteristics of the sound according to the identified dominant frequency to detect the sound of interest.

The present invention also provides a method for detection of a particular sound of interest amongst a plurality of other dynamically varying sounds. The method comprises of steps of identifying a dominant frequency present in a spectrum of sound energy, modifying a mel filter bank by revising spectral position of a first mel filter bank and a second mel filter bank according to the identified dominant frequency for detection of the sound of interest and extracting a plurality of spectral characteristic of the sound received from the modified filter bank. The method further comprises of classifying the extracted spectral characteristics of the sound to detect the sound of interest according to the identified dominant frequency.

DETAILED DESCRIPTION

Some embodiments of this invention, illustrating its features, will now be discussed:

The words "comprising", "having", "containing", and "including", and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a", "an", and "the" include plural references unless the context clearly dictates otherwise. Although any systems, methods, apparatuses, and devices similar or equivalent to those described herein can be used in the practice or testing of embodiments of the present invention, the preferred, systems and parts are now described. In the following description for the purpose of explanation and understanding reference has been made to numerous embodiments for which the intent is not to limit the scope of the invention.

One or more components of the invention are described as module for the understanding of the specification. For example, a module may include self-contained component in a hardware circuit comprising of logical gate, semiconductor device, integrated circuits or any other discrete component. The module may also be a part of any software programme executed by any hardware entity for example processor. The implementation of module as a software programme may include a set of logical instructions to be executed by the processor or any other hardware entity. Further a module may be incorporated with the set of instructions or a programme by means of an interface.

The disclosed embodiments are merely exemplary of the invention, which may be embodied in various forms.

The present invention relates to a system and method for detection of sound of interest amongst a plurality of other dynamically varying sounds. In the very first step, a dominant frequency is identified in the spectrum of the sound of interest and a modified mel filter bank is obtained by modifying and shifting the structure of a first mel filter bank and a second mel filter bank. Features are then extracted from the modified mel filter bank and are classified to detect the sound of interest.

Figure 1:
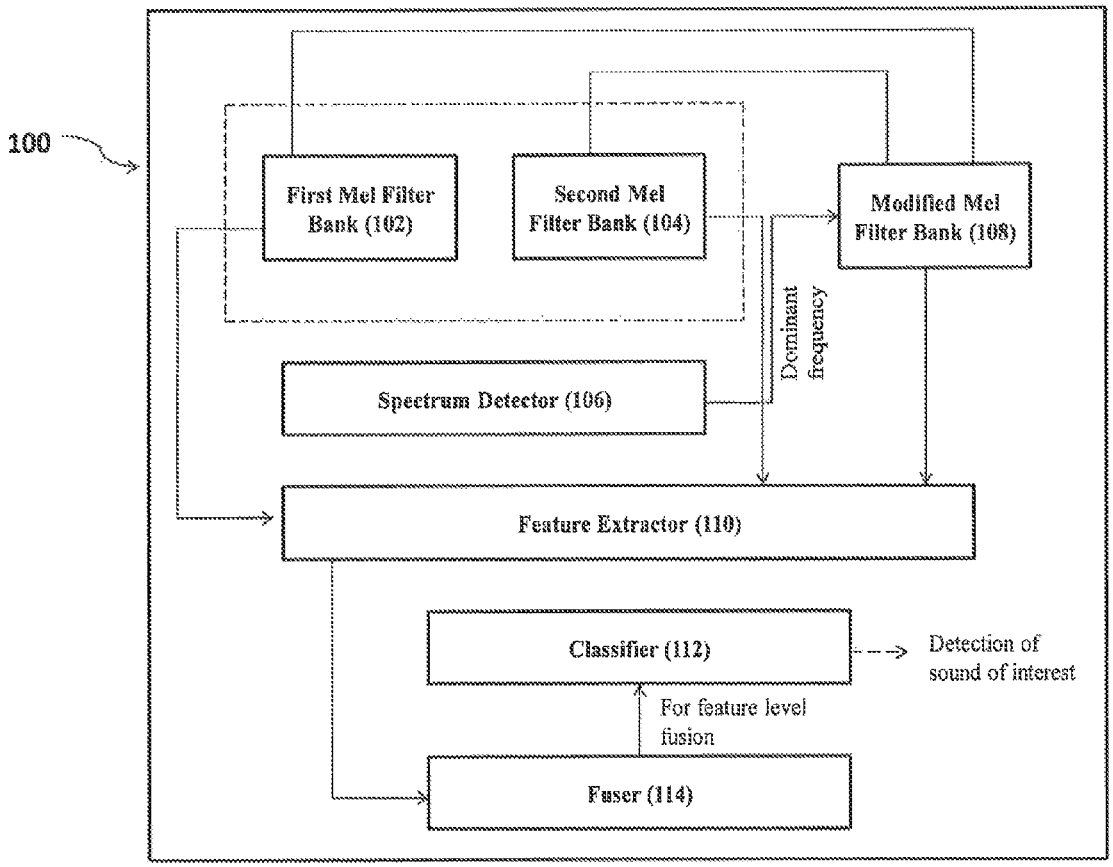
FIG. 1 illustrates the system architecture in accordance with an embodiment of the system.

In accordance with an embodiment, referring to FIG. 1, the system (100) comprises of a first mel filter bank (102) configured to provide MFCC (Mel Frequency Cepstral Coefficients) of a sound of interest. The MFCC is a baseline acoustic feature for speech and speaker recognition applications.

A mel scale is defined as:

$$f_{mel} = 2595 \log_{10}\left(1 + \frac{f}{700}\right)$$

Where $f_{mel}$ is the subjective pitch in Mels corresponding to f, the actual frequency in Hz.

The algorithm used to calculate MFCC feature is as follows:

1. Take a fixed size time window from the signal by using some window function like hamming, hanning or rectangular window (as shown in step 802 of FIG. 8)
2. Compute the discrete fourier transform of windowed signal.
3. Map the powers of the spectrum obtained above onto the mel scale, using triangular overlapping windows.
4. Compute the energy at each of the mel filter and take the logs of the computed energy values.
5. Finally MFCC is computed by taking the discrete cosine transform of these log energy values (as shown in step 808 of FIG. 8).

In accordance with an embodiment, the system further comprises of a second mel filter bank (104). The second mel filter bank (104) is an inverse of the first mel filter bank (102).

Figure 3:
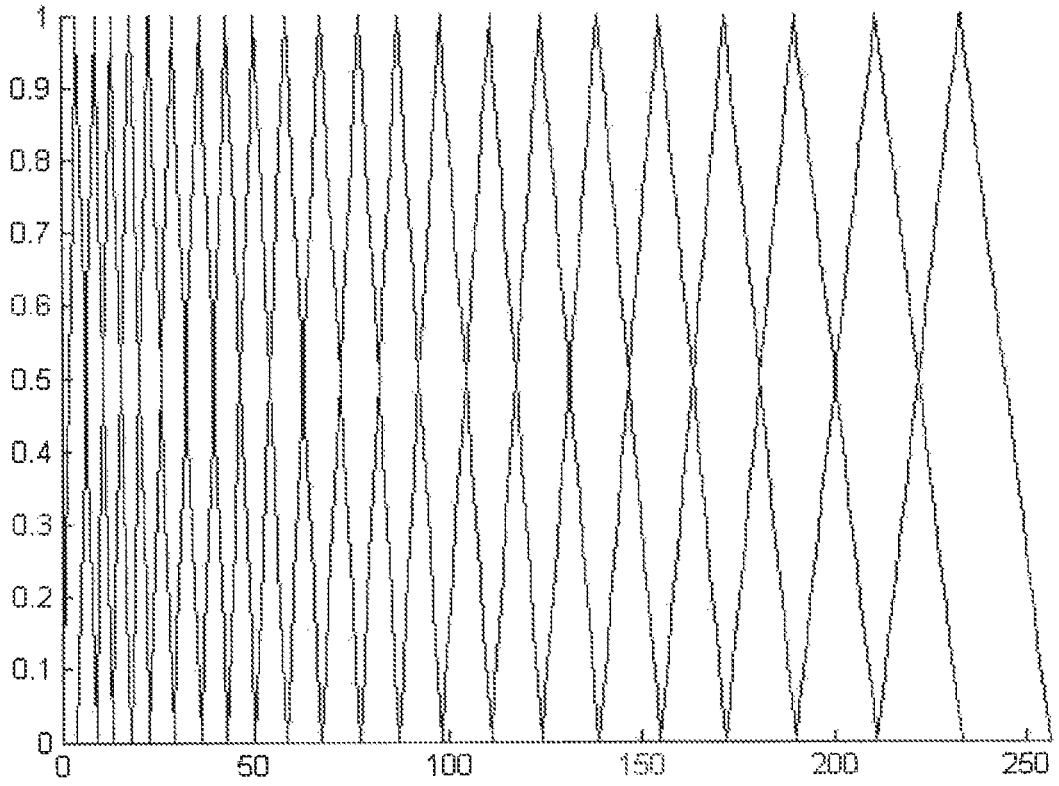
FIG. 3 illustrates the structure of first mel filter bank in accordance with an embodiment of the invention.
Figure 4:
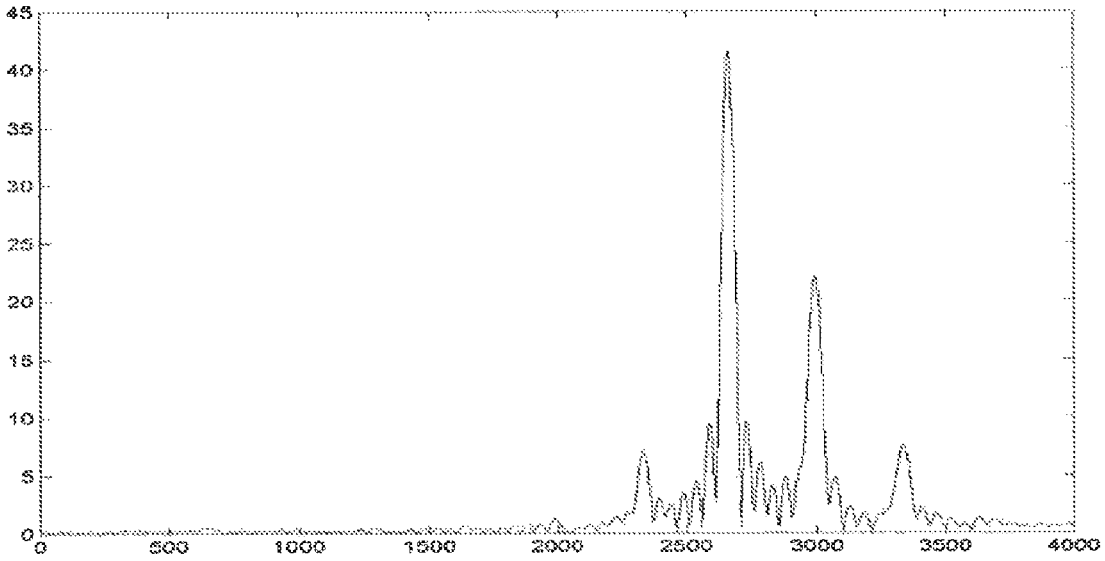
FIG. 4 illustrates the spectrum of the sound of interest in accordance with an embodiment of the invention.
Figure 4:
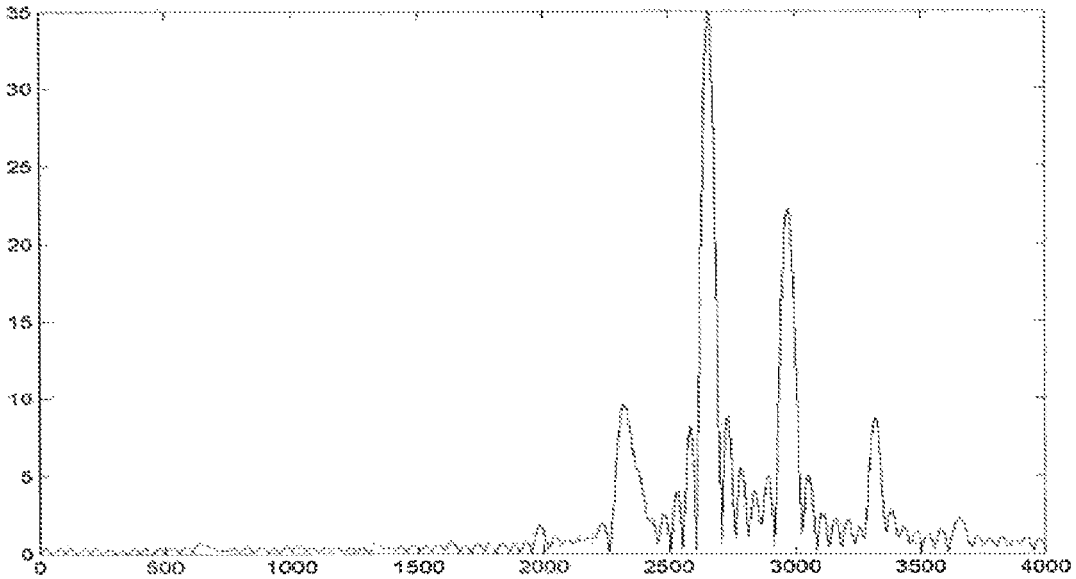
Figure 6:
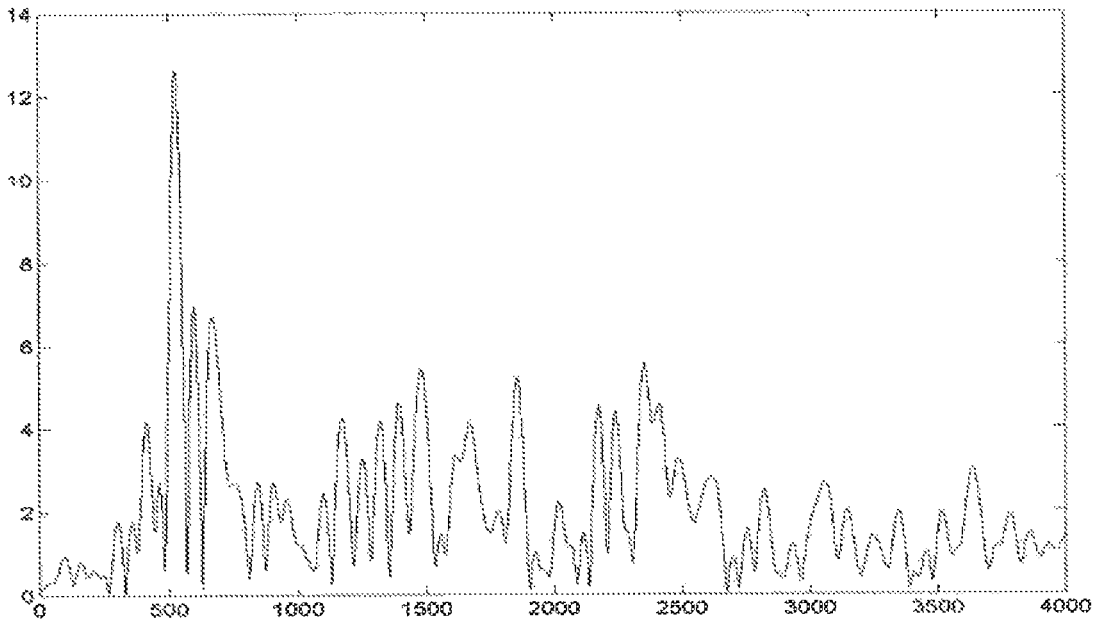
FIG. 6 illustrates the spectrum of other dynamically varying sounds in accordance with an embodiment of the invention.
Figure 6:
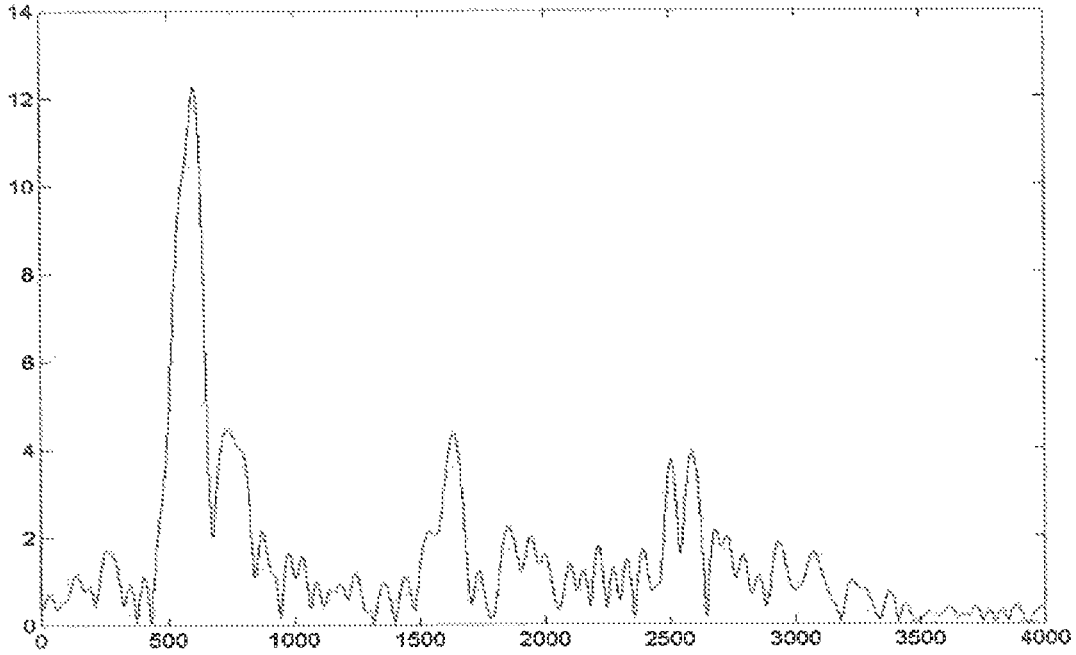

As illustrated in FIG. 3, the first mel filter bank (102) structure has closely spaced overlapping triangular windows in lower frequency region while smaller number of less closely spaced windows in the high frequency zone. Therefore, the first mel filter bank (102) can represent the low frequency region more accurately than the high frequency region. But for the sound of interest amongst a plurality of other dynamically varying sounds, by way of a specific example, the sound of interest may include but is not limited to sound of horns in an automobile; most of the spectral energy is confined in the high frequency region as shown in FIG. 4. The spectral energy of other dynamically varying sounds (for example other traffic sounds) is shown in FIG. 6.

Figure 5:
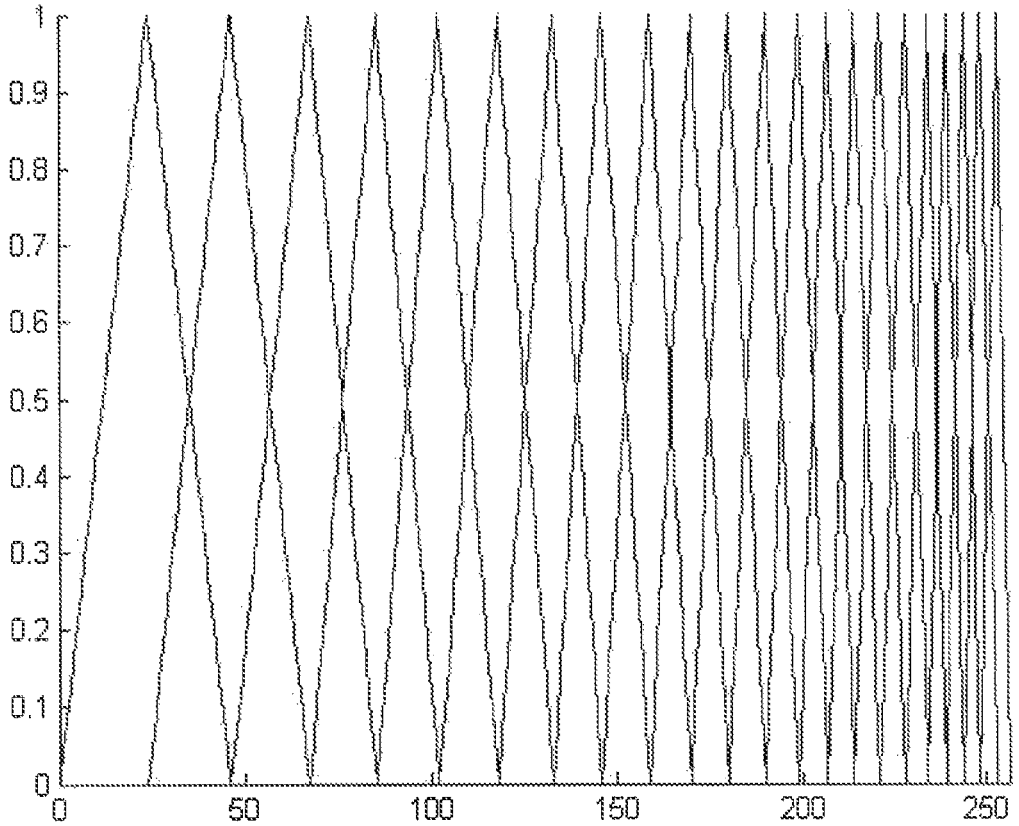
FIG. 5 illustrates the structure of the second mel filter bank in accordance with an alternate embodiment of the invention.

Therefore, the structure of first mel filter bank (102) is reversed, in order to design the second mel filter bank (104), higher frequency information can be captured more effectively which is desired for the sound of interest i.e. sound of horn. The structure of second mel filter bank (104) is shown in FIG. 5.

The equation employed in designing the second mel filter bank (104) is given below:

$$f_{mel} = 2146 - 2595\log_{10}\left(1 + \frac{4000 - f}{700}\right)$$

Figure 8:
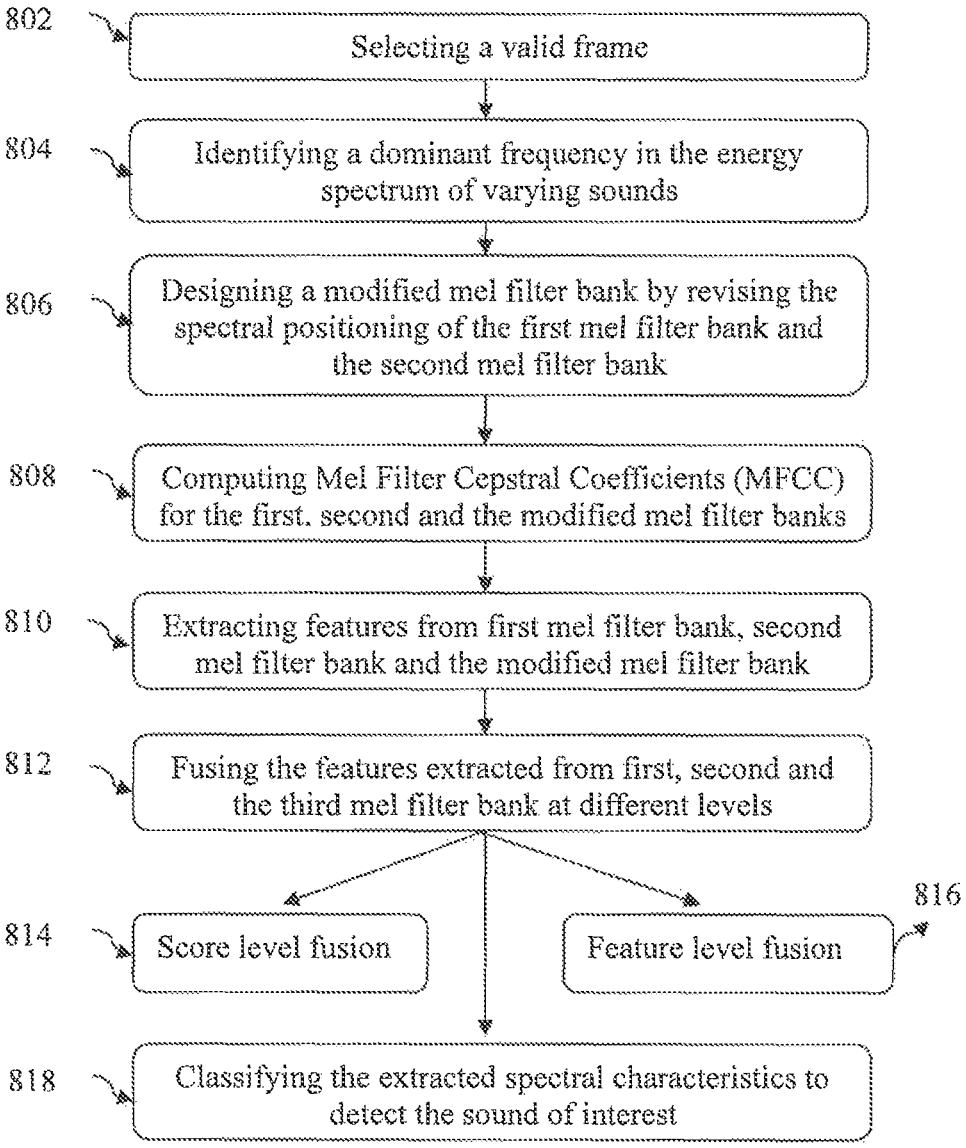
FIG. 8 illustrates an exemplary flowchart in accordance with an alternate embodiment of the invention.

The MFCC feature for the second mel filter bank (104) are calculated in a similar manner as calculated for the first mel filter bank (as shown in step 808 of FIG. 8).

Further it is also observed that in one or more of the cases, for the sound of interest the spectral energy is mainly concentrated in lower frequency region. In all these cases, the second mel filter bank (104) (i.e. inverse of first mel filter bank) does not work very well as it cannot capture the lower frequency information very effectively.

Hence, it was concluded that in order to distinguishably capture the feature information from the sound of interest and to differentiate it from the other dynamically varying sounds, varying nature of spectral energy distribution of sound should be considered while designing any mel filter bank structure.

The system (100) further comprises of a spectrum detector (106) to identify a dominant spectrum energy frequency by detecting a dominant spectrum energy band present in a spectrum of sound energy of the varying sounds (as shown in step 804 of FIG. 8).

In order to identify a dominant frequency in the energy spectrum, the complete spectrum is divided into a particular number of frequency bands. Spectral energy of each band is computed and the frequency band which gives maximum energy is called the dominant spectral energy frequency band. In the next step, a particular frequency is selected as the dominant frequency in that dominant spectral energy frequency band.

The system (100) further comprises of a modified mel filter (108) bank which is designed by shifting first mel filter bank (102) and the second mel filter bank (104) around the detected dominant frequency (as shown in step 806 of FIG. 8).

In accordance with an embodiment, any frequency index can be taken as dominant peak in that frequency band, depending on the requirements of application and sounds under consideration.

The modified mel filter bank (108) thus designed can provide the maximum resolution in the part of spectrum where maximum spectral energy is distributed and hence can extract the more effective information from the sound.

While designing the modified mel filter bank (108), the first mel filter bank (102) is constructed and the complete first mel filter bank (102) is shifted by the dominant peak frequency in such a manner that it occupies the frequency range from dominant peak frequency ($f_{peak}$) to maximum frequency of the signal ($f_{max}$).

The governing equation for this modification is:

$$f = 700 \square\left(10^{\frac{f_{mel}}{2595}} - 1\right) + f_{peak}$$

Where $$f_{peak} \le f \le f_{max}$$

In the same manner, the complete second mel filter bank (104) is also shifted by dominant frequency such that it ranges from minimum frequency of the signal ($f_{min}$) to dominant frequency ($f_{peak}$). The equation used for this is given below:

$$f = 4000 - 700\square\left(10^{\frac{2146 - f_{mel}}{2595}} - 1\right) - (f_{max} - f_{peak})$$

where $$f_{min} \le f \le f_{peak}$$

The MFCC features for the modified mel filter bank (108) are calculated in a similar manner as described for the first mel filter bank (102) and the second mel filter bank (104) (as shown in step 808 of FIG. 8)

The system (100) further comprises of a feature extractor (110) coupled with the modified mel filter bank (108), the first mel filter bank (102) and the second mel filter bank (104). The feature extractor (110) extracts a plurality of spectral characteristics of the sound received from all three types of mel filter banks (as shown in step 810 of FIG. 8).

In a further observation, all three MFCC features i.e. for the first mel filter bank (102), the second mel filter bank (104) and the modified mel filter bank (108) provide different feature information of the sound of interest which effectively represents the different spectral characteristics of the sound of interest.

Figure 7:
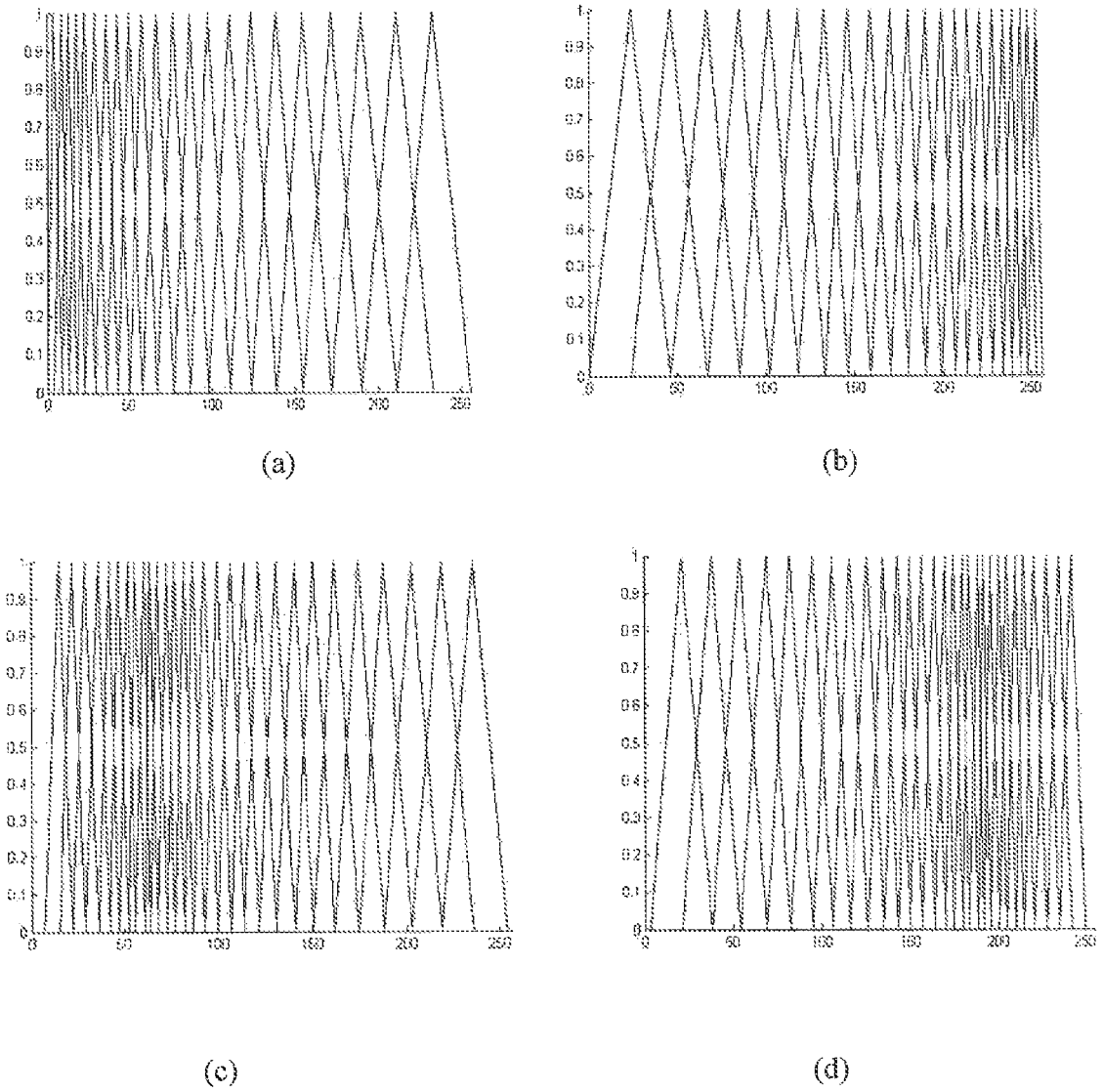
FIG. 7 illustrates the structure of the modified mel filter bank with various dominant spectral energy band in accordance with an exemplary embodiment of the invention.

By way of specific example, as illustrated in FIG. 7, the complete spectrum is divided into two energy bands i.e. 0-2 KHz and 2-4 KHz to design the modified mel filter bank (108) structure. In 0-2 KHz energy band (FIG. 7*a*), zero frequency is taken as dominant peak frequency whereas 4 KHz is selected as dominant peak frequency in the 2-4 KHz band (FIG. 7*b*). Other frequencies may also be taken as dominant peak frequency for redefining the filter bank dominant frequency could be taken as 1 KHz (FIG. 7*c*) and dominant frequency could also be taken as 3 KHz (FIG. 7*d*). The structure of modified mel filter bank for different configurations of dominant spectral energy band and dominant peak is shown in the FIG. 7.

As illustrated in FIG. 1, the system (100) further comprises of a fuser (114) configured to provide a performance evaluation of the system (100). The fuser (114) fuse the features extracted from the first mel filter bank (102), the second mel filter bank (104) and the modified mel filter bank (108). For performance evaluation, score level [6] fusion (as shown in FIG. 2) and feature level fusion [5](as shown in FIG. 1) are used.

Still referring to FIG. 1, (as shown in step 816 of FIG. 8) in feature level fusion, pair wise features are concatenated and finally all the three types (first mel filter bank (102), the second mel filter bank (104) and the modified mel filter bank (108)) are combined. Before starting the combination, some normalization techniques for example, Max normalization is used for normalizing the features which compensates the different range of feature values.

Figure 2:
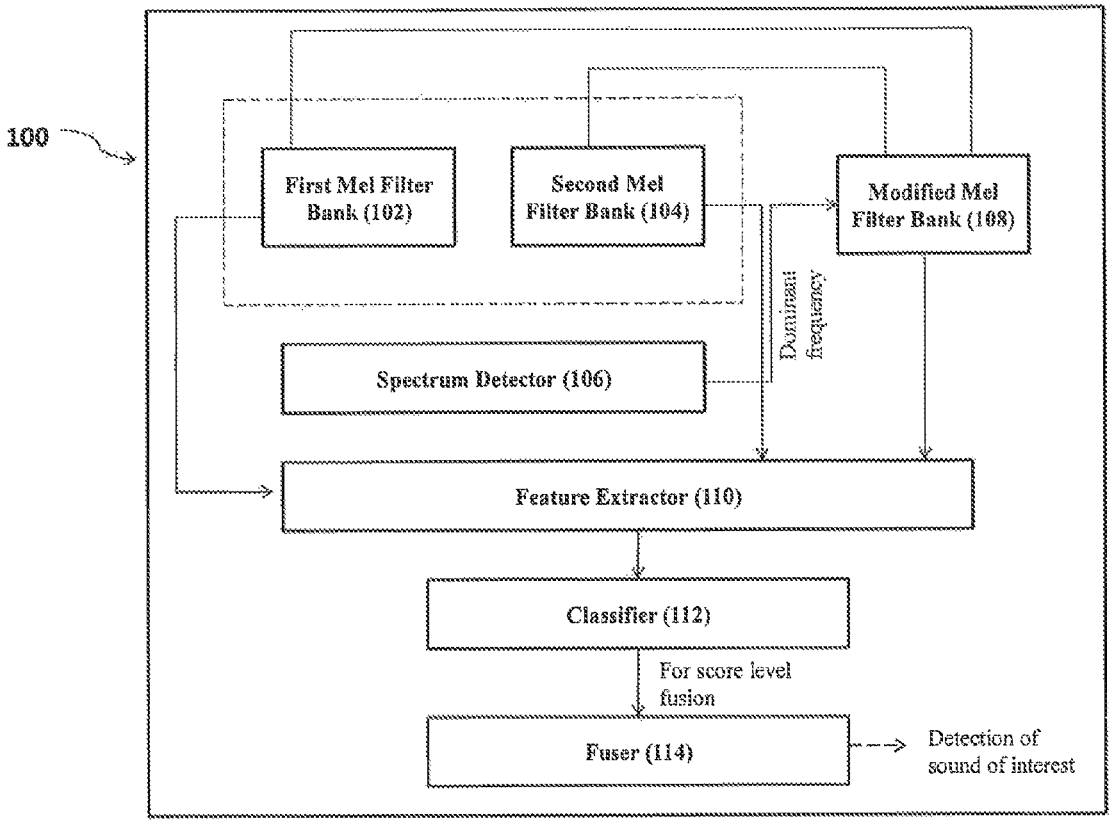
FIG. 2 illustrates the system architecture in accordance with an alternate embodiment of the system.

Referring to FIG. 2, (as shown in step 814 of FIG. 8), same feature combinations can be used in score level fusion which is performed by obtaining separate classification scores for each feature. Combination of these scores is then performed by using simple sum rule of fusion for final classification score. Here also, Max normalization technique is used to compensate different range of classification scores.

The system (100) further comprises of a classifier (112) trained to classify the extracted spectral characteristics of the sound according to the identified dominant frequency to detect the sound of interest (as shown in step 818 of FIG. 8). The classifier (112) further comprises of but is not limited to a Gaussian Mixture Model (GMM) to classify the extracted spectral characteristics of the sound of interest.

In accordance with an embodiment, the classifier (112) further comprises of a comparator (not shown in figure) communicatively coupled to the classifier (112) to compare the classified spectral characteristics of the sound of interest with a pre stored set of sound characteristics in order to effectively detect the sound of interest.

BEST MODE/EXAMPLE FOR WORKING OF THE INVENTION

Figure 9:
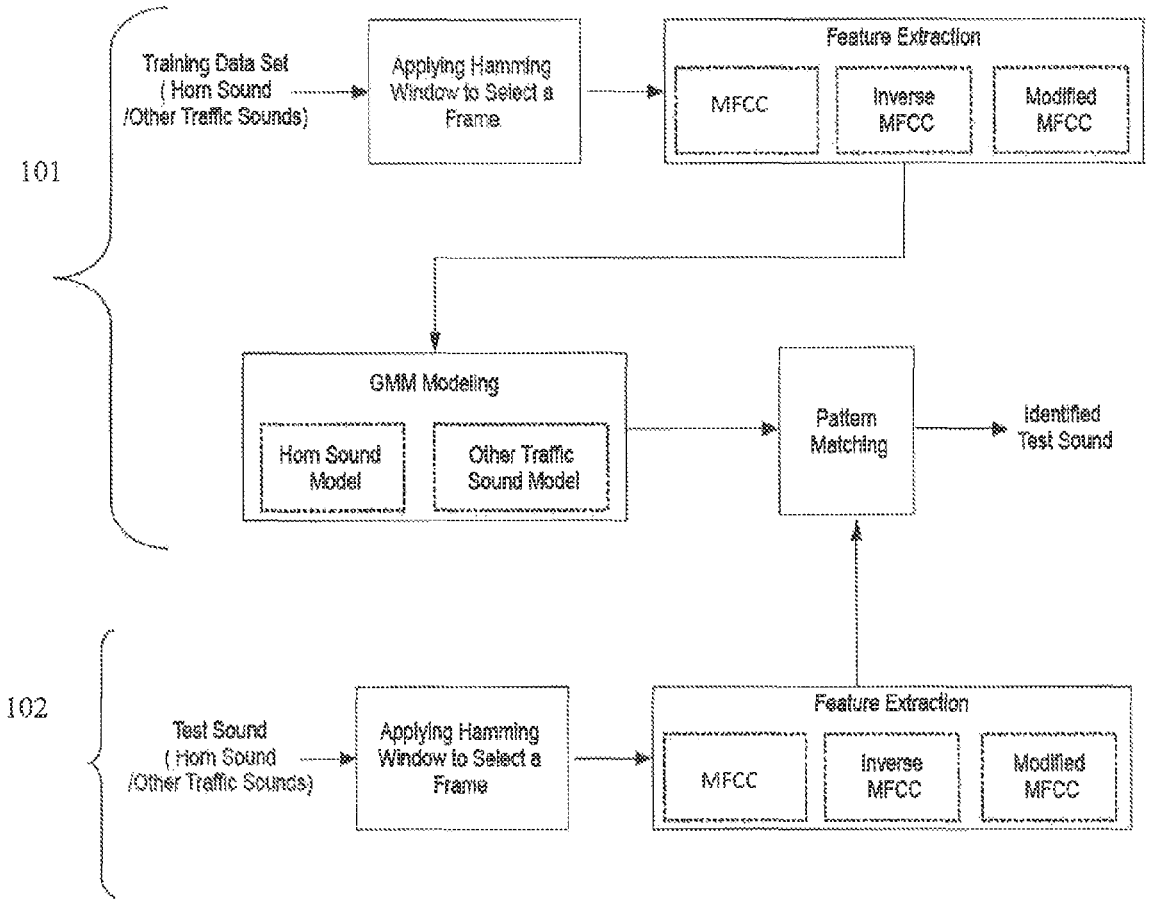
FIG. 9 illustrates the block diagram of the system in accordance with an exemplary embodiment of the system.

The system and method illustrated for the detection of sound of interest amongst a plurality of other dynamically varying sounds may be illustrated by a working example showed in the following paragraph; the process is not restricted to the said example only:

As illustrated in FIG. 9, let us consider a case of identifying horn sound amongst various other traffic sounds. For this, data is selected for training purpose which comprises of data related to horn sound and data related to other traffic sounds. The complete database is divided into two main classes i.e. horn sound and other traffic sounds. Referring to step (101), for training, 1 minute recorded data is used for each sound class. Referring to step (102), testing is done on 2 minutes horn data which includes 137 different sound recordings for horn and approximately 10 minutes data for other traffic sounds, having 87 different recordings. These training and test data set is prepared from the recordings of different sessions so that the robustness of proposed system can be checked for varying conditions.

In order to select a valid frame, hamming window is applied to both training data set as well as test sound. Based on spectral energy distribution, first mel filter bank, second mel filter bank (inverse of first mel filter bank) and the modified mel filter bank. In the feature extraction stage, conventional MFCC (referring to the first mel filter bank) is used with inverse MFCC (referring to the second mel filter bank) and modified MFCC for comparative study. With respect to the valid frame selected, Mel Frequency Cepstral Coefficients (MFCC) is computed and further features are extracted from all the three mel filter banks. In all these MFCC computations, 13 dimensional features are used. Modeling is done by using Gaussian mixture model (GMM) for different number of mixtures and finally test sounds are classified on maximum likelihood criterion from these trained models.

Pattern matching is performed with respect to one or more pre stored sound and test sound is identified.

TABLE 1

Horn Classification Results for Conventional MFCC, Inverse MFCC (IMFCC) and Modified MFCC Features

| No. of | Detected Horn Sounds (out of 137) | | | Detected Other Sounds (out of 87) | | |
|---|---|---|---|---|---|---|
| Gaussian Mixtures | MFCC | IMFCC | Modified MFCC | MFCC | IMFCC | Modified MFCC |
| 2 | 113 | 119 | 122 | 85 | 84 | 84 |
| 4 | 122 | 119 | 129 | 84 | 84 | 84 |
| 8 | 122 | 117 | 122 | 81 | 84 | 84 |
| 16 | 122 | 115 | 126 | 83 | 84 | 84 |
| 32 | 119 | 123 | 128 | 84 | 83 | 83 |
| 64 | 121 | 124 | 120 | 83 | 82 | 83 |
| 128 | 122 | 123 | 122 | 82 | 80 | 82 |
| 256 | 123 | 123 | 122 | 80 | 81 | 81 |
| 512 | 126 | 130 | 131 | 81 | 80 | 71 |

These experimental results clearly indicate that the horn detection rate improves in case of the inverse MFCC features as compared to the conventional MFCC which justifies the reversing of conventional mel filter bank structure based on spectral characteristics of horn sound and hence makes the inverse MFCC better feature choice for improved horn classification accuracy.

Again in case of modified MFCC, horn detection rate improves significantly for all Gaussian mixture model sizes as compared to conventional MFCC and inverse MFCC which shows the importance of spectral energy distribution in MFCC feature computation and hence makes the modified MFCC more suitable feature for horn detection. Similarly, false alarm rate (FAR) also reduces in case of modified MFCC and inverse MFCC feature as compared to conventional MFCC.

Further the performance of above system can be evaluated by including the derivative features of all these MFCC variations i.e. conventional MFCC, inverse MFCC and modified MFCC which can help in the analysis of classification accuracy against the increased computational complexity.

ADVANTAGES OF THE INVENTION

1. Modifications in existing feature extraction techniques with respect to the characteristics of horn sound effectively differentiate it from other sounds.
2. Designing the inverse mel filter bank in order to compute MFCC captures more information in high frequency region of the sound spectrum.
3. MFCC computed with respect to the modified mel filter bank results in an improved classification.
4. Varying nature of spectral energy distribution is utilized in MFCC computation by modifying the existing mel filter bank structure which provides a generalized feature for a particular type of sound detection.

We claim:

1. A system for detection of a sound of interest amongst a plurality of dynamically varying sounds, the system comprising:

a spectrum detector to identify a dominant frequency by detecting a dominant spectrum energy band present in a spectrum of sound energy of dynamically varying sounds;

a first mel filter bank and a second mel filter bank that each comprises mel filters that filter a frequency band of the sound energy for detecting the sound of interest;

a modified mel filter bank modified according to the dominant frequency includes a revised spectral positioning of the first mel filter bank ranging from the dominant frequency to a maximum frequency and the second mel filter bank ranging from a minimum frequency to the dominant frequency for detection of the dynamically varying sound of interest;

a feature extractor, coupled with the modified mel filter bank, to extract a plurality of spectral characteristics of sound received from the modified filter bank; and a classifier to classify the plurality of spectral characteristics of the sound according to the dominant frequency to detect the sound of interest.

2. The system as claimed in claim 1, wherein the second mel filter bank is an inverse of the first mel filter bank.

3. The system as claimed in claim 1, wherein the classifier includes a Gaussian Mixture Model (GMM) to classify the spectral characteristics of the sound of interest.

4. The system as claimed in claim 1, wherein the dynamically varying sounds includes a horn sound in an automobile.

5. The system as claimed in claim 1, wherein the system further comprises:

a fuser to fuse the features extracted from the first mel filter bank, the second mel filter bank, and the modified mel filter bank to provide a performance evaluation of the system.

6. A method for detection of a sound of interest amongst a plurality of dynamically varying sounds, the method comprising steps of:

identifying a dominant frequency present in a spectrum of sound energy;

modifying a mel filter bank according to the dominant frequency by revising a spectral position of a first mel filter bank ranging from the dominant s frequency to the maximum frequency and a second mel filter bank ranging from the minimum frequency to the dominant frequency for detection of a dynamically varying sound of interest;

extracting a plurality of spectral characteristic of a sound received from the modified filter bank; and classifying the plurality of spectral characteristics of the sound to detect the sound of interest according to the dominant frequency, wherein the identifying, the modifying, the extracting, and the classifying are performed by a processor by executing programmed instructions stored in a memory coupled with said processor.

7. The method as claimed in claim 6, wherein the dominant frequency includes a frequency of band with maximum energy in the energy spectrum of the sound of interest.

8. The method as claimed in claim 6, wherein the method further comprises:

fusing, by the processor, the features extracted from the first mel filter bank, the second mel filter bank, and the modified mel filter bank in order to provide a performance evaluation while detecting the sound of interest.

9. A non-transitory computer-readable medium storing instructions that, when executed by a processor, cause the processor to perform a method, the method comprising steps of:

identifying a dominant frequency present in a spectrum of sound energy;

modifying a mel filter bank according to the dominant frequency by revising a spectral position of a first mel filter bank ranging from the dominant frequency to the maximum frequency and a second mel filter bank ranging from the minimum frequency to the dominant frequency for detection of a dynamically varying sound of interest;

extracting a plurality of spectral characteristic of a sound received from the modified filter bank; and classifying the plurality of spectral characteristics of the sound to detect the sound of interest according to the dominant frequency.

10. The non-transitory computer-readable medium as claimed in claim 9, wherein the dominant frequency includes a frequency of band with maximum energy in the energy spectrum of the sound of interest.

11. The non-transitory computer-readable medium as claimed in claim 9, wherein the method further comprises:

fusing the features extracted from the first mel filter bank, the second mel filter bank, and the modified mel filter bank in order to provide a performance evaluation while detecting the sound of interest.

* * * * *